United States Patent [19]

Bennett

[11] 4,107,804

[45] Aug. 22, 1978

[54] WAVE MOTION ISOLATOR BETWEEN BUOY AND CABLE-SUSPENDED INSTRUMENTATION PACKAGE

[75] Inventor: Derek J. Bennett, Thousand Oaks, Calif.

[73] Assignee: Bunker Ramo Corporation, Oak Brook, Ill.

[21] Appl. No.: 848,907

[22] Filed: Nov. 7, 1977

Related U.S. Application Data

[63] Continuation of Ser. No. 721,054, Sep. 7, 1976, abandoned.

[51] Int. Cl.[2] ..... B63B 21/52

[52] U.S. Cl. ..... 9/8 R; 242/107.11; 340/2

[58] Field of Search ..... 9/8 R, 8.3 R; 242/107.1, 107.11, 107.12, 107.13; 340/2, 3 R; 102/14

[56] References Cited

U.S. PATENT DOCUMENTS

| | | | |
|---|---|---|---|
| 492,808 | 3/1893 | Jenkins | 242/107.11 |
| 700,517 | 5/1902 | Lindsay et al. | 242/107.11 |
| 1,217,941 | 3/1917 | Hobbs | 242/107.11 |
| 2,052,341 | 8/1936 | Douglass | 242/107.11 |
| 2,758,203 | 8/1956 | Harris | 340/2 |
| 3,196,469 | 7/1965 | Anthony | 9/8 R |
| 3,543,228 | 11/1970 | Farmer et al. | 9/8 R |
| 3,597,778 | 8/1971 | Castelliz | 9/8 R |

FOREIGN PATENT DOCUMENTS

| | | | |
|---|---|---|---|
| 13,159 | 1/1903 | Norway | 242/107.11 |

*Primary Examiner*—Trygve M. Blix
*Assistant Examiner*—Jesus D. Sotelo
*Attorney, Agent, or Firm*—F. M. Arbuckle; A. Freilich

[57] ABSTRACT

A wave motion isolator for use in suspending a submersible instrument package from a surface buoy by a cable payed out from a pack attached to the instrumentation package. The isolator is comprised of a spring-powered spool which turns on an axle rigidly connected between two bars with guide sheaves attached at each end of the bars. A loop of cable near the buoy is attached to the spring-powered spool and so wound onto the spool that both sides of the loop are payed out simultaneously, thus winding a spiral spring tight around the axle of the spool. One end of the loop passes over a guide sheave at the top of the bars, and the other end passes over a guide sheave at the bottom of the bars.

8 Claims, 5 Drawing Figures

WAVE MOTION ISOLATOR BETWEEN BUOY AND CABLE-SUSPENDED INSTRUMENTATION PACKAGE

This is a continuation, of application Ser. No. 721,054, filed Sept. 7, 1976, now abandoned.

BACKGROUND OF THE INVENTION

This invention relates to a system for the compliant suspension of an instrumentation package at some predetermined ocean depth from a buoy, and more particularly to a system for isolating the instrument package from wave motion of the buoy while the package is suspended from the buoy at a predetermined depth by a cable payed out from a pack attached to the submerged instrument package.

In underwater instrumentation packages, such as in a hydrophone installation for sonobuoys, it is desirable to have the transducer suspended in a stable position at a predetermined depth below the ocean surface. This is because the instrumentation package serves as a platform for the transducers which, as in the case of a hydrophone, may be sensitive to vertical motion imparted through the suspension cable by surface waves acting on the buoy. To achieve stability, motion damper assemblies have been developed, in addition to specialized configurations in buoy systems. A typical prior-art motion damper uses a low spring-rate elastomeric rod as a link in the suspension cable, as shown in U.S. Pat. Nos. 3,377,615 and 3,543,228. Since the suspension cable also serves as a communication cable, and insulated signal wire loosely wound around the elastomeric rod electrically connects the ends of the inner conductors of the suspension cables otherwise linked only by the elastomeric rod. A problem with the elastomeric rod as a compliant link is that the length and bulk of the compliant rod becomes prohibitive for the terminal mass (mostly coupled water mass) attached below the link because of the very low spring rate required for wave-induced motion.

SUMMARY OF THE INVENTION

A wave motion isolator for use in suspending a submersible instrument package from a buoy by a cable employs a spool which turns on an axle between two parallel bars. The center of a loop in the cable is fastened to the spool, and wound around the spool with both sides of the loop in the same direction. Means for storing spool rewinding energy is connected to the spool and the bars to store spool rewinding energy in response to the spool turning relative to the bars as the loop is unwound under increasing tension of the cable at both ends of the loop in opposite directions, and to rewind the loop on the spool under decreasing tension. At least two guide means are provided between the bars, one on each side of the spool for guiding the cable at opposite ends of the loop past ends of the bars and preventing the bars from rotating as the loop of cable is wound and unwound under varying tension by operation of the rewinding energy storing means on the spool. In preferred embodiments, the rewinding energy storing means is comprised of a spiral spring inside a hollow cylinder of the spool. The outer end of the spring is connected to the hollow cylinder, and the inner end of the spring is connected to the axle.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
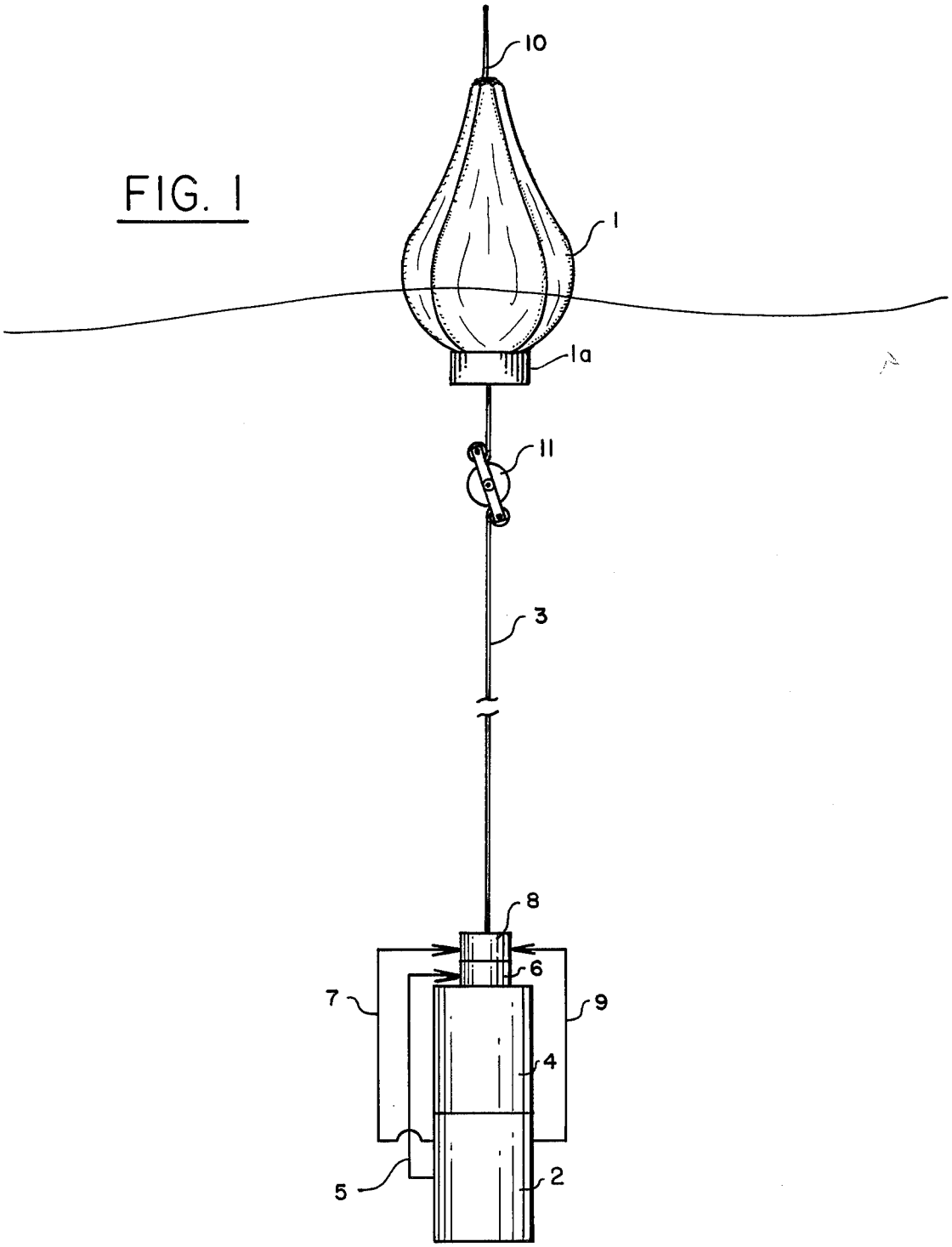
FIG. 1 is a schematic diagram illustrating the manner in which the invention is used with an instrumentation package suspended from a buoy by a cable.

Referring now to FIG. 1 of the drawings, a buoy 1 is shown deposited or deployed in a body of water with an electronic instrumentation package 2, such as an acoustical detection system, for transmitting through an insulated cable 3 data in respect to sounds detected by a hydrophone. The cable is payed out from a coil pack 4 attached to the instrumentation package 2.

The package contains seawater-activated batteries which not only energize electronic circuits for transmitting data to the buoy through the cable, but also energize circuits for selecting the depth (payed-out cable length) according to some predetermined criteria, such as descending time after energization, or water pressure. Once the necessary amount of cable is payed out an insulated brake lead is energized to actuate a braking mechanism 6. After a predetermined delay, as determined by a clock pulse counter in the package 2, an insulated penetrator lead 7 is energized to actuate a mechanism 8 which causes an insulated shunt lead 9 to electrically connect the payed-out cable 2 to the end of the cable in the pack 4, or to effectively connect the payed-out cable directly to the signal output of the package 2. In that manner, signals transmitted to a receiver/transmitter la at the buoy bypass the remaining cable in the pack 6. The receiver amplifies the signal and codes it for transmission through an antenna 10.

A motion isolator 11 near the buoy allows the buoy to rise and fall with the ocean waves without disturbing the electronic package and cable pack. The inertia of that mass, plus the mass of the payed-out cable, will stabilize the height of the electronic package above the ocean floor (i.e., the nominal depth below the water surface) sufficiently for the data gathering mission. This isolation of wave motion can be very important to a mission. For example, motion of a hydrophone in the ocean can seriously impair its preformance and mask any sonic signals radiated from a target. Reduction of motion, and in particular wave-induced motion, is therefore a major concern in sonobuoy system design.

The technique which has heretofore been used to prevent the surface buoy motion from being transmitted down the suspension cable to the hydrophone is to insert in the suspension cable a low spring-rate elastomeric rod, as noted hereinbefore. However, because of the very low spring rate required and the increased weight of more sophisticated sensors the length and bulk of the compliant link becomes too great. In accordance with a preferred embodiment of this invention, a spring-powered spool is utilized to obtain a compliant link of improved performance and less packaging volume, i.e., less length and bulk.

Figure 3:
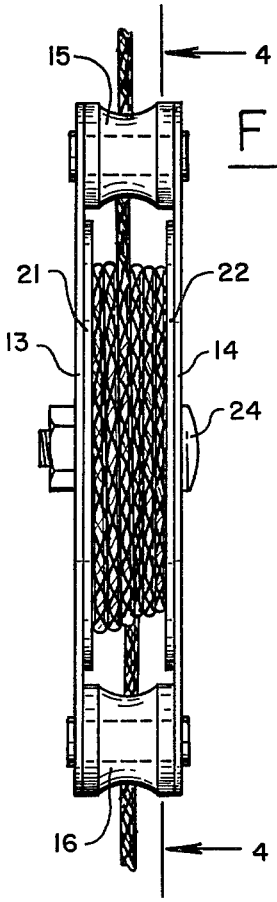
FIG. 3 is an end view of the invention.
Figure 2:
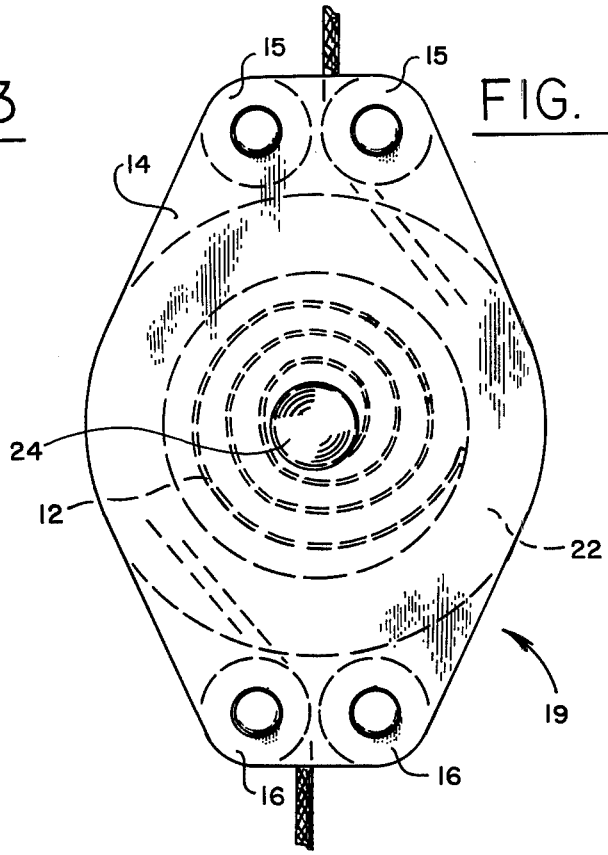
FIG. 2 is a side view of the invention.
Figure 4:
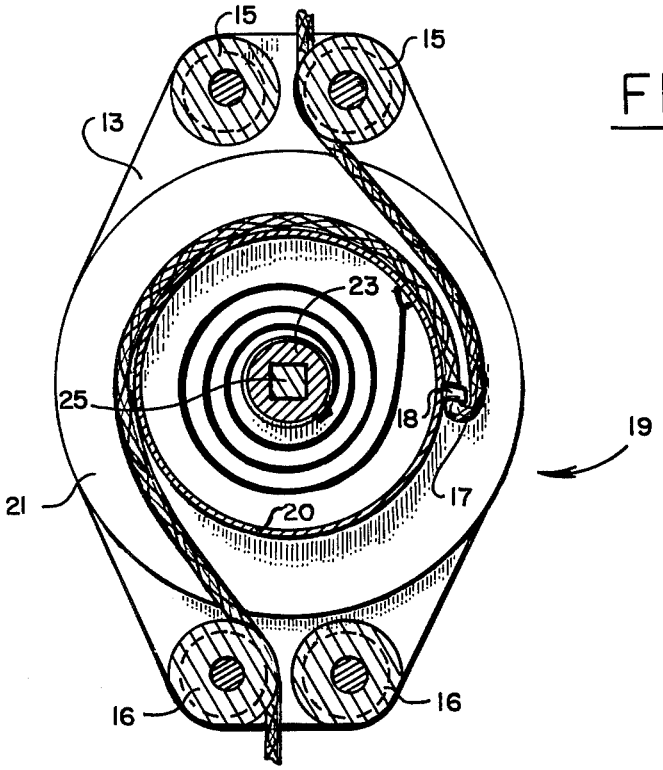
FIG. 4 is a sectional view taken on a line 4—4 in FIG. 3.

Referring now to FIGS. 2, 3 and 4, the power spring consists of a high-tensile, flat metal strip 12 which is formed around a mandrel into a spriral. Stressed in this manner, the spring provides a fairly uniform restoring torque over a wide range of turns. Once this spring element is mounted inside a cable spool, it becomes an isolator mechanism as shown in FIGS. 2 and 3. The spring-powered spool is mounted between two bars 13 and 14 with sheaves 15 and 16 attached to each end. The center 17 of a loop of cable near the buoy is fastened to the spool by a metal strap 18. The loop is then wound onto the spool, designated by the numeral 19, such that both ends of the loop are payed out simultaneously. The spool 19 consists of a hollow cylinder 20 (shown in the sectional view of FIG. 4 taken along a line 4—4 in FIG. 3) fixed between two disks 21 and 22. Each disk has a hole through which an axle 23 passes. One end of the spring 12 is fastened to the inside of the cylinder 20 which is free to turn on the axis of the axle. The other end of the spring is connected to the axle 23 which is locked in position relative to the bars 13 and 14 by a bolt 24 having a square shank 25.

As a wave lifts the buoy, the cable wrapped around the spring-powered spool is payed out, thus wrapping the spring tighter around the axle 23. When the wave that lifted the buoy passes, the buoy drops, and the spring-powered spool takes in the slack. While the cable is under tension, as it normally is once the sonobuoy has been deployed, only one of each of the pairs of guide sheaves 15 and 16 is engaged, as shown in FIG. 2. The other sheave of each pair serves as a guide only during initial deployment when, for a time, the cable may actually engage them as the system begins to pay out cable. In actual practice, those additional guide sheaves may be omitted, particularly if weight becomes critical for the mission, as suggested in FIG. 1.

A motion isolator employing a spiral spring in this manner may be made quite small. For example a motion isolator having a maximum dimension of 4.5 inches has been successfuly built. Another advantage is that it can be stowed flat between the buoy and the cable pack to form a compact unit to be deployed. Once in the water, the submersible instrumentation package descends. While the cable pack pays out cable, the motion isolator functions as a tension damper on the cable. After the braking mechanism 6 (FIG. 1) is activated, the spiral spring will stabilize the length of the wound loop for the nominal depth of the submersible package. Thereafter, it will pay out more loop for upward wave-induced motion of the buoy, and take in some of the loop for downward wave-induced motion of the buoy.

Figure 5:
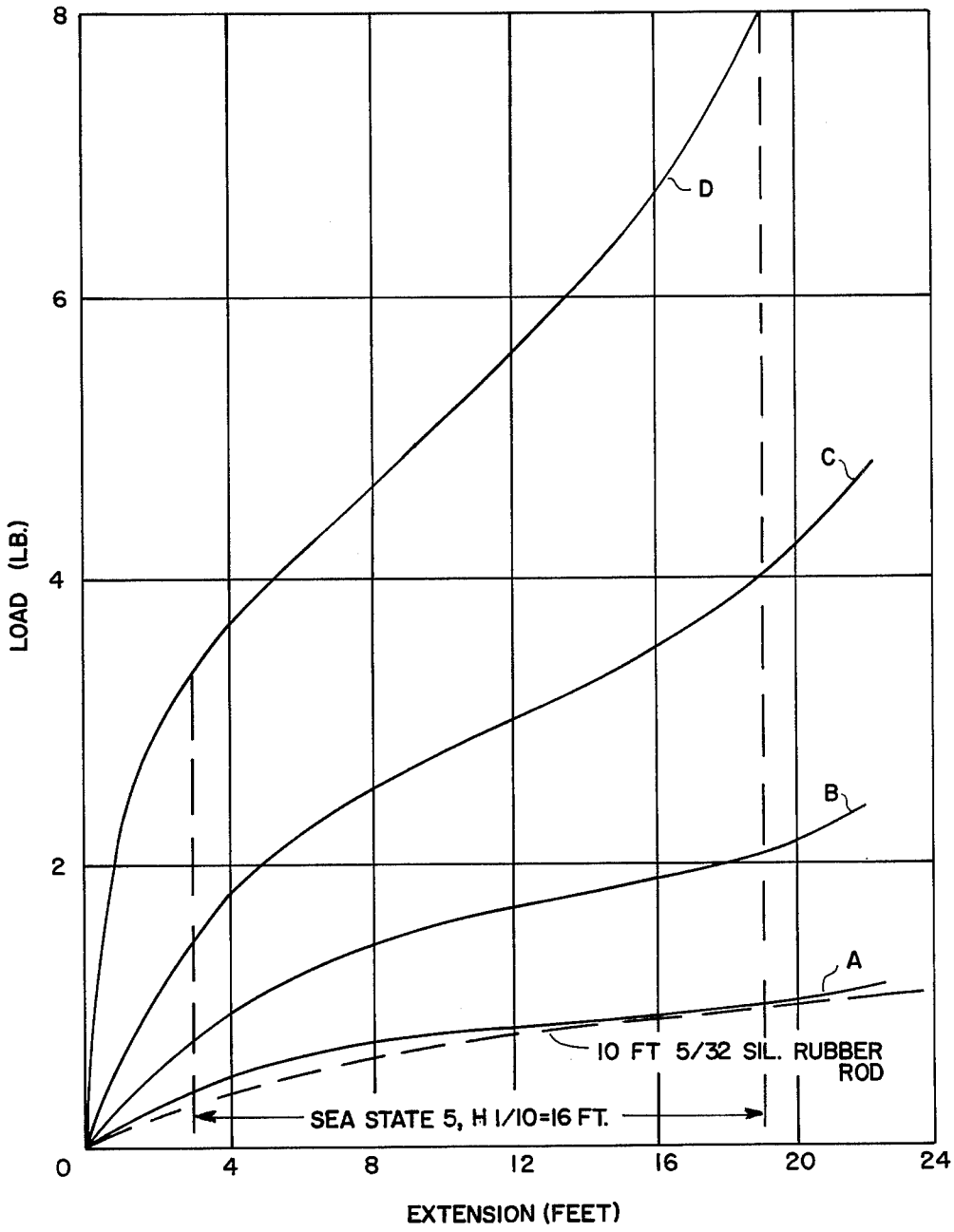
FIG. 5 is a graph of load-extension characteristics of springs in the invention.

A further advantage of this invention is that a wide range of load-extension characteristics can be accommodated by altering the spring thickness or width, or both. A typical range of these characteristics is shown plotted in FIG. 5 for applications ranging from a low load (e.g., passive sonobuoy) to a high load (e.g., active sonobuoy). In the case of the low load, spring performance (curve A) is comparable to 10 feet of 5/32 inch diameter silicone rubber rod used as a motion isolator in accordance with the prior-art patents referred to hereinbefore. The spring performance for the next higher load (curve B) is approximately equal to 30 feet of silicone rubber rod of the same diameter. Higher load-extension characteristics can be readily achieved, as shown in curves C and D, by merely increasing the thickness and/or width of the spiral spring material.

Regarding the advantage of size, it should be noted that the total bulk of the buoy and submersible package (cable and instrumentation with a motion isolator in between) can be significantly reduced by the present invention. That is indicated by the length (10 to 30 feet) of silicone rubber rods needed in the prior art systems to achieve the load-extension characteristics in the range of curves A and B which can be achieved by the present invention without increasing the size (4.5 inch length) of the motion isolator. This reduction in bulk is summarized for the load range of curves A to D of FIG. 5 in the table below.

| | | PRESENT INVENTION | | | |
|---|---|---|---|---|---|
| Common-Size Sonobuoy | | Width L (in.) | Approx. Wt. (lb) | Package Vol. (in.$^3$) | Prior Art Rubber rod Isolator (in.$^3$) |
| Passive: | A | 0.75 | 0.4 | 6.8 | (10 ft × 0.375* dia) = 13.3 |
| | B | 0.75 | 0.5 | 6.8 | |
| | C | 1.25 | 0.7 | 11.3 | (30 ft × 0.375* dia) = 39.8 |
| Active: | D | 1.25 | 1.0 | 11.3 | *Includes helical cable form. |

This table shows that for light weight loads (curve A), the bulk (packing volume) is reduced by about 50%. For mid-weight loads (curve C) the volume is reduced by about 70%, and for heavy loads (curve D), the reduction in bulk is expected to be significantly more than 80%.

Although a particular embodiment of the invention has been described and illustrated herein, it is recognized that modifications and equivalents may readily occur to those skilled in the art. Consequently, it is intended that the claims be interpreted to cover such modifications and equivalents.

The embodiments of the invention in which an exclusive property or privilege is claimed are described as follows:

1. A wave motion isolator for dynamically compliant suspension of a submersible instrument package from a buoy in a body of water having significant waves by a cable comprising: two parallel bars; an axle fixed between said bars; a spool mounted on said axle to turn between said bars; said spool being comprised of a hollow cylinder spaced about said axle; a high-tensile, flat metal strip formed into a spiral, one end of said strip being attached to said axle and the other end being attached to said hollow cylinder to provide fairly uniform restoring torque for any revolutions of said cylinder about said axle; means for attaching the center of a loop in said cable to said spool with both sides of said loop wound around said spool in the same direction; whereby as said loop is unwound under increasing tension of cable at both ends of said loop in opposite directions, said metal strip functions as an energy storing means being connected to said spool and said bars to rewind said loop on said spool under decreasing tension of said cable at both ends of said loop; and at least two guide sheaves mounted between said bars, one on each side of said spool for guiding said cable at opposite ends of said loop past ends of said bars and preventing said bars from rotating as said loop of cable is wound and unwound under varying tension by operation of the rewinding energy restoring means on said spool.

2. A wave motion isolator as defined in claim 1 wherein said flat metal spring is selected to have selected width and thickness dimensions for the load of said submersible instrument package and payed out cable to provide compliant pay-out of cable from said spool in response to wave-induced motion of said buoy while said submersible instrument package is suspended at a predetermined depth.

3. A wave motion isolator as defined in claim 2 wherein said cable is an insulated electrical conductor which serves as an electronic communication link between said instrumentation package and said buoy.

4. A wave-motion isolator for dynamically compliant suspension of a submersible instrument package from a buoy in a body of water having significant waves by a cable payed out from a pack attached to said instrument package comprising: a spiral spring; two parallel bars; and axle rigidly connected between said bars; a spool comprising a hollow cylinder spaced about said axle with said spiral spring comprised of a high-tensile, flat metal strip formed into a spiral, said spiral spring being housed in the space between said axle and said cylinder with one end attached to said axle and the other end attached to said cylinder, said spool further having two parallel disks, a separate one of said disks being centered at each end of said axle with a centered hole just large enough to fit and turn freely on said axle between said bars; a guide sheave between said parallel bars on each side of said spool each sheave being mounted clear of said spool to turn freely on a shaft secured between said bars with its axis parallel to the axis of said spool axle; and a loop of said cable taken near said buoy, said loop having the center thereof attached to said spool cylinder and both sides of said loop wound together on said spool in the same angular direction of the sprial of said spring from the axle to said cylinder such that as both ends of the loop are payed out simultaneously under tension, one end of said loop passing between one of said sheaves and said spool, and the other end of said loop passing between the other one of said sheaves and said spool, whereby any wave motion which causes said buoy to move up and down will provide isolation of said buoy for compliant suspension of said instrument package as the spiral spring is tightened in response to said cable being payed out from said loop wound on said spring.

5. A wave motion isolator as defined in claim 4 wherein said flat metal spring is selected to have selected width and thickness dimensions for the load of said submersible instrument package and payed out cable to provide compliant pay-out of cable from said spool in response to wave-induced motion of said buoy while said submersible instrument package is suspended at a predetermined depth.

6. A wave motion isolator as defined in claim 5 including two addtional guide sheaves, one at each end of said parallel bars, each sheave being mounted to turn freely on a shaft secured between said bars, with its axis parallel to the axis of said axle with one end of one side of said loop passing between said one of said sheaves and one additional sheave, and the other end of one side of said loop passing between said other one of said sheaves and the other additional sheave.

7. A wave motion isolator as defined in claim 5 wherein said cable is an insulated electrical conductor which serves as an electronic communication link between said instrumentation package and said buoy.

8. A wave motion isolator for use in dynamically stabilizing the vertical position of a submersible instrument package suspended in a body of water having significant waves from a buoy by a cable comprising a spool having a hollow cylinder between two disks; an axle passing through holes in said disks centered on the axis of said hollow cylinder; a spiral spring comprised of a high-tensile, flat metal strip formed into a spiral, said spring being in said hollow cylinder with its outside end connected to said hollow cylinder and its inside end connected to said axle; a pair of parallel bars, one at each end of said axle; means for securing said axle to said bars and for preventing said axle from turning on its axis relative to said bars; a loop of said cable; means for connecting the center of said cable loop to a fixed point on the outside of said hollow cylinder, both sides of said loop being wound together in the same angular direction, said direction being the angular direction of the spiral of said spring from the axle to the cylinder, and at least two guide sheaves between said parallel bars, one at each end of said bars for guiding said cable under tension between said instrument package and said buoy as said spool turns in either angular direction relative to said bars.

* * * * *